US005267886A

United States Patent [19]

Wood et al.

[11] Patent Number: 5,267,886

[45] Date of Patent: Dec. 7, 1993

[54] MULTIPLE ACTION PLUSH TOY

[75] Inventors: Josephine D. Wood, Hermosa; Peter A. Lam, Torrance, both of Calif.

[73] Assignee: Mattel, Inc., El Segundo, Calif.

[21] Appl. No.: 832,290

[22] Filed: Feb. 7, 1992

[51] Int. Cl.[5] ..... A63H 33/26

[52] U.S. Cl. ..... 446/175; 446/72; 446/268; 446/330

[58] Field of Search ..... 446/72, 81, 175, 219, 446/268, 297, 330, 369, 397, 414, 984, 485, 486

[56] References Cited

U.S. PATENT DOCUMENTS

| | | | |
|---|---|---|---|
| 844,577 | 2/1907 | Borchardt | 446/484 X |
| 1,110,100 | 9/1914 | Ambash et al. . | |
| 1,900,353 | 3/1933 | Marchetti | 446/175 |
| 2,003,765 | 6/1935 | Widen | 446/175 |
| 2,370,601 | 2/1945 | Wimpfheimer et al. . | |
| 2,694,772 | 11/1954 | Gelardin . | |
| 2,744,189 | 5/1956 | Wudyka . | |
| 2,932,917 | 4/1960 | Patane . | |
| 2,933,853 | 4/1960 | Laval, Jr. . | |
| 3,034,258 | 5/1962 | Schwartz . | |
| 3,621,356 | 11/1971 | Kwan | 446/175 X |
| 3,791,068 | 2/1974 | Pietrowiak . | |
| 3,808,418 | 4/1974 | Conard et al. . | |
| 3,849,931 | 11/1974 | Gulley, Jr. | 446/175 |
| 4,464,861 | 8/1984 | Fogarty et al. | 446/175 X |
| 4,479,329 | 10/1984 | Fraden | 446/219 X |
| 4,547,171 | 10/1985 | Horimoto . | |
| 4,673,371 | 6/1987 | Furukawa | 446/175 |
| 4,675,519 | 6/1987 | Price | 446/175 |
| 4,717,363 | 1/1988 | Refabert | 446/175 X |
| 4,734,074 | 3/1988 | Kinberg et al. . | |
| 4,757,491 | 7/1988 | Koike | 446/175 X |
| 4,773,888 | 9/1988 | Worsham et al. . | |

*Primary Examiner*—Robert A. Hafer
*Assistant Examiner*—Sam Rimell
*Attorney, Agent, or Firm*—Roy A. Ekstrand

[57] ABSTRACT

A plush toy is configured to replicate a dog and includes a battery-powered squeeze-operated light within one of the dog's front feet. The light is operated by raising the light supporting foot and squeezing the foot to energize the battery-powered light. A control circuit within the toy body controls a plurality of flashing lights and a sound output speaker to produce a series of predetermined sounds together with flashing lights when the control circuit is triggered. A pair of light responsive motion sensors are supported within the toy body and respond to changes of seam in close proximity to the front portion of the toy to trigger the operation of the control circuit and the production of sound and flashing lights. A manual trigger switch is also provided to initiate sound and light flashing.

11 Claims, 2 Drawing Sheets

MULTIPLE ACTION PLUSH TOY

FIELD OF THE INVENTION

This invention relates generally to plush toys and particularly to those which provide various actions and sounds.

BACKGROUND OF THE INVENTION

Plush toys provide the consumer with a variety of toys replicating animals and humans or the like which are extremely user friendly. This is due, in part, to the characteristic of plush toys which provide a soft padded body which is usually covered by a soft outer "skin" providing a pleasant feel or touch. In many instances, the outer skin includes a soft coat such as simulated animal fur or the like. In efforts to enhance the play value of plush toys, practitioners in the art have provided additional activities which have included animation or movement capability, sound producing capability, and various illumination schemes to light up some or all of the plush toys.

As the popularity of plush toys has continued, practitioners have endeavored to meet consumer desires for evermore interesting and enjoyable plush toys by providing a variety of such toys. For example, U.S. Pat. No. 4,464,861 issued to Fogarty, et al. sets forth a PLUSH TOY in which an elongated plush representing a fanciful caterpillar or the like is provided with an internal cavity supporting a battery-powered light assembly and a squeeze-operated switch mechanism. The plush toy further includes an illuminatable head portion secured to the body enclosing the lamp portion of the interior battery-powered light. Thus, when the body of the plush toy is squeezed, the battery-powered light source is activated illuminating the head and face of the plush toy to provide a glow.

U.S. Pat. No. 3,808,418 issued to Conard, et al. sets forth a LIGHT FLASHING APPARATUS which may, for example, be supported within a plush toy. The light flashing apparatus includes a piezoelectric crystal together with means for compressing the piezoelectric crystal and generating electrical energy. An electric circuit including a lamp is coupled to the crystal such that compression of the crystal energizes the electrical circuit and the lamp to produce light.

U.S. Pat. No. 1,110,100 issued to Ambash, et al. sets forth a TOY FIGURE which resembles a bear or similar animal and which defines an interior cavity. Within the interior cavity, a battery-powered electric circuit includes an on/off switch and one or more batteries together with a pair of lamps supported within the bear's eyes. In operation, the squeezing of the bear abdomen activates the electric circuit and illuminates the eyes of the bear.

U.S. Pat. No. 2,370,601 issued to Wimpfheimer, et al. which sets forth a SMALL FLASHLIGHT STRUCTURE resembling a toy dog or the like. A housing within the dog body interior supports a battery power source and one or more illuminatable lamps are positioned in correspondence to the dog's eyes. When the battery power source is activated, the dog's eyes are illuminated.

U.S. Pat. No. 2,694,772 issued to Gelardin sets forth a FLASHLIGHT WITH HERMETICALLY SEALED CASING which is formed in general correspondence to a fanciful representation of a dog or similar animal. An interior cavity within the animal body supports a battery-powered flashlight mechanism including a lamp which extends forwardly through a hole in the animal's nose.

U.S. Pat. No. 2,744,189 issued to Wudyki sets forth a PORTABLE LAMP which is formed to generally replicate a small monkey. The monkey is configured to attach to a vehicle antenna in appearance of climbing the same. A hollow cavity within the monkey's body supports a battery-powered flashlight which illuminates the head portion of the monkey.

U.S. Pat. No. 2,932,917 issued to Patane sets forth a TOY DOLL which generally replicates a human infant having a translucent face and soft body. Within the body interior, an elongated battery-powered flashlight is supported together with switch means operative when the doll body is squeezed. The lamp portion of the battery-powered flashlight is supported within the interior of the doll's head portion and energizing of the battery-powered light causes the head portion to glow.

U.S. Pat. No. 2,933,853 issued to Laval, Jr. sets forth a TOY FIGURE formed in a general replication of an upright positioned rabbit. The rabbit includes a soft plush body together with an internal battery-powered light source which illuminates selected portions of the toy figure.

U.S. Pat. No. 3,034,258 issued to Schwartz sets forth a HAND PUPPET WITH FINGERTIP CONTROLLED ILLUMINATABLE NOSE which generally replicates a human clown. The puppet includes an extending translucent nose supporting a flashlight bulb therein. A battery-powered energy source and switch are supported within the puppet interior such that the switch may be operated from within the puppet by the hand enclosed therein to energize the bulb and illuminate the nose.

U.S. Pat. No. 3,791,068 issued to Pietrowiak sets forth a DUAL FACE ILLUMINATED DOLL having a human-like torso and supporting a pair of oppositely facing human faces integrally formed into a common head. An internal light source within the doll body energizes a lamp within the doll head to cause the faces to glow.

U.S. Pat. No. 4,547,171 issued to Horimoto sets forth a STUFFED TOY having a generally rigid base supporting a stuffed toy body having an interior cavity therein. A battery-powered light source is supported within the doll body upon the base and, when energized, illuminates the toy figure.

U.S. Pat. No. 4,734,074 issued to Kinberg, et al. sets forth an ANIMATED NOVELTY DEVICE shaped in the form of an owl-like creature and having a flexible body and illuminatable eyes. An associated sound producing device is located within the body of the animated device and is arranged such that pressure applied to the body portion causes the simultaneous lighting of the eyes and the production of an associated sound.

U.S. Pat. No. 4,773,888 issued to Worsham, et al. sets forth a SCARECROW DOLL which consists of a scarecrow-like doll body having electronic sound producing means supported therein. A pair of lightbulbs are supported within the scarecrow's eyes and are energizable in combination with the sound generator.

While the foregoing described prior art devices have provided some increased entertainment and amusement value and have, in some instances, enjoyed considerable commercial success, there remains nonetheless a continuing need in the art for evermore improved and interesting plush toys and the like.

SUMMARY OF THE INVENTION

Accordingly, it is a general object of the present invention to provide an improved plush toy. It is a more particular object of the present invention to provide an improved plush toy which produces dramatic light and sound effects and which responds to objects in front of the plush toy.

In accordance with the present invention, there is provided a toy comprises: a body defining a movable appendage; a light source supported within the movable appendages; circuit means for producing a predetermined series of audible sounds; and motion sensing means responsive to object movement in proximity to the body operating to activate the circuit means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
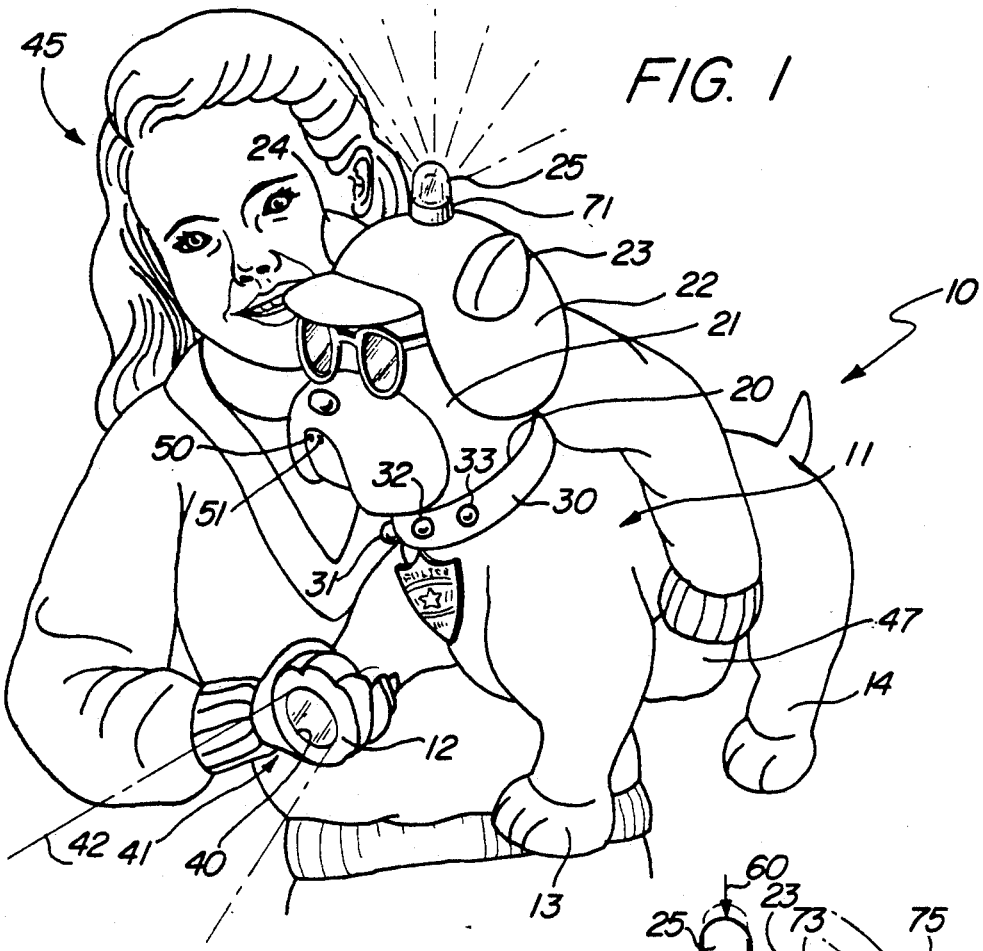
FIG. 1 sets forth a perspective view of a multiple action plush toy constructed in accordance with the present invention together with a child user.

FIG. 1 sets forth a perspective view of a plush toy constructed in accordance with the present invention and generally referenced by numeral 10. Plush toy 10 is fabricated in accordance with conventional plush toy fabrication techniques and is configured to generally represent a dog similar to a bulldog or the like. It will be apparent, however, to those skilled in the art that plush toy 10 may be configured in a variety of shapes and sizes without departing from the spirit and scope of the present invention. Plush toy 10 includes a body 11, a neck 20, a head 21 and feet 12 through 15 (the latter not seen) all configured in accordance with the replication of a bulldog-type dog. A collar 30 is received upon and supported by neck 20 and supports a plurality of light producing elements 31 through 33. In their preferred form, light producing elements 31 through 33 include conventional incandescent lightbulbs of the "flashlight" sized variety. Head 21 is covered by a simulated hat 22 which, in turn, supports an upwardly extending domed light 25. A pair of motion sensors 50 and 51 are supported upon the mouth portion of plush toy 10. Foot 12 defines an interior cavity supporting a battery-powered light source (seen in FIG. 2). The undersurface of foot 12 defines an aperture 40 which permits light beam 42 to shine outwardly from battery-powered light unit 41 (seen in FIG. 2).

In a typical play pattern, a child user generally referenced by numeral 45 secures one hand 47 about body 11 of plush toy 10 and generally supports the weight of toy 10 by holding body 11. User 45 then employs the user's remaining hand 46 to flex foot 12 of plush toy 10 forwardly to a generally horizontal orientation and thereafter squeezing foot 12 to activate the internal light source and produce a light beam 42 extending outwardly through aperture 40. In its preferred form, battery-powered light 41 is active solely when foot 12 is squeezed and remains off during other circumstances.

Figure 2:
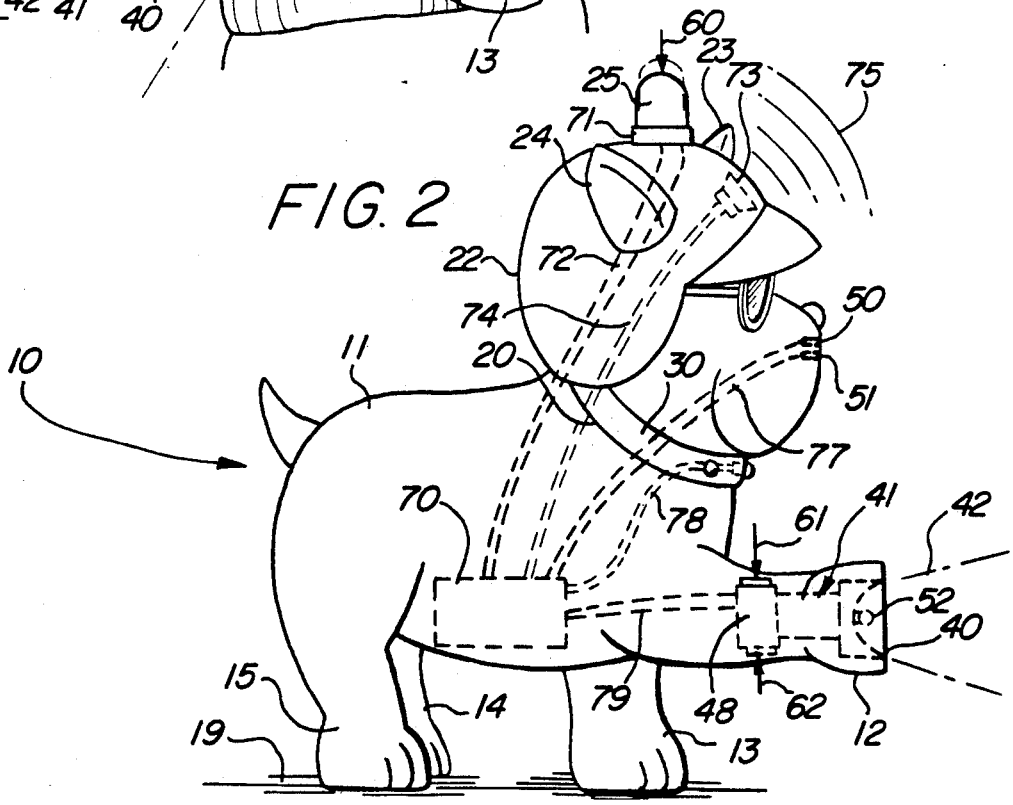
FIG. 2 sets forth a side elevation view of a multiple action plush toy constructed in accordance with the present invention.

FIG. 2 sets forth a side elevation view of plush toy 10 resting upon a play surface 19. As described above, plush toy 10 includes a body 11, feet 12 through 15, and a head 21. Head 21 supports a hat 22 and an upwardly extending domed light 25. Light 25 includes a push-operated switch 71 constructed in accordance with conventional fabrication techniques. Plush toy 10 further includes a pair of simulated ears 23 and 24 extending outwardly through hat 22. A collar 30 encircles neck portion 20 of plush toy 10 and supports a trio of lightbulbs 31 through 33 (better seen in FIG. 1). In the position shown in FIG. 2, plush toy rests upon feet 13, 14 and 15 while foot 12 is raised to a generally horizontal orientation. As described above, foot 12 defines an aperture 40 on the lower surface thereof and supports a battery-powered light source 41 Light source 41 may be constructed in accordance with conventional fabrication techniques including a battery-powered source (not shown) and a push-operated switch 48. In accordance with the present invention, foot 12 may be raised to the position shown in FIG. 2 and thereafter, squeezed to compress switch 48 in the direction indicated by arrows 61 and 62 thereby energizing light source 41 and producing an outwardly shining beam of light 42.

A control circuit 70, the structure of which is set forth below in FIG. 3, includes a set of connecting wires 72 coupling control circuit 70 to switch 71 and light 25. Control circuit 70 further includes a set of connecting wires 78 coupling control circuit 70 to light elements 31 through 33 within collar 30. Similarly, a set of connecting wires 77 extends from control circuit 70 to a pair of motion sensors 50 and 51. For purposes of illustration, motion sensors 50 and 51 are shown hidden within the front muzzle portion of head 21 of the present invention plush toy. However, it will be apparent to those skilled in the art that motion sensors 50 and 51 may be supported at virtually any frontal position on plush toy 10 to achieve the present invention operation set forth below by which the motion of objects in front plush toy 10 is sensed by control circuit 70. A speaker 73 is supported within hat 22 and is coupled to control circuit 70 by a connecting wire set 74.

Figure 3:
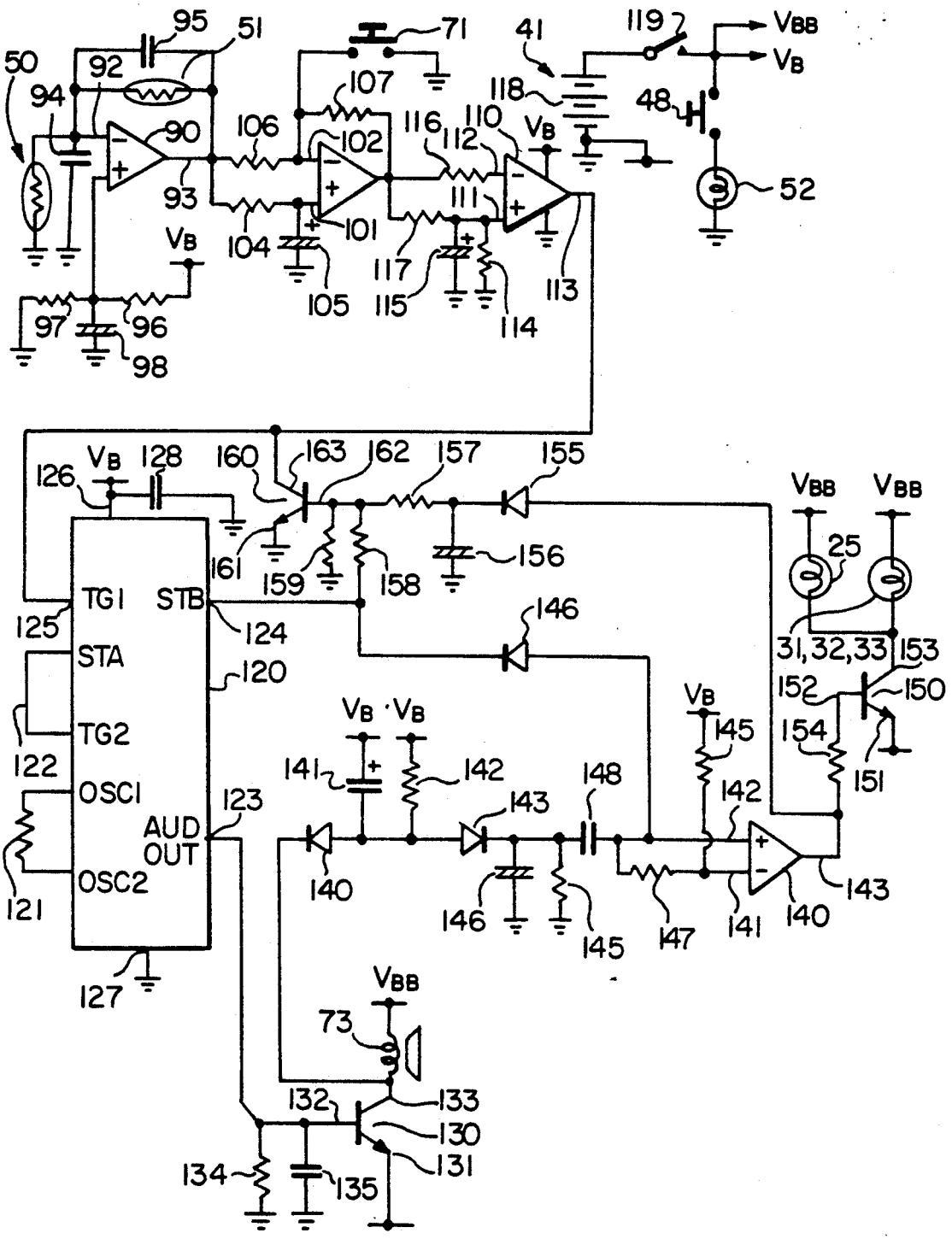
FIG. 3 sets forth a schematic diagram of the electronic circuit operating means of the present invention multiple action plush toy.

In the anticipated play pattern for which the structure of control circuit 70 set forth below in greater detail in FIG. 3 is intended, light 25 and light elements 31 through 33 on collar 30 may be operated in a flashing mode when circuit 70 is activated. In addition, a sound producing system within control circuit 70 (seen in FIG. 3) may be operated to energize speaker 73 via connecting wire set 74 to produce a sound emission 75.

In operation, light source 41 may be operated in the manner described above independently from control circuit 70 to provide the above-described flashlight action. In addition, control circuit 70 is operative each time light 25 is pushed downwardly in the direction indicated by arrow 60 thereby activating switch 71 to cause control circuit 70 to energize speaker 73 and produce a succession of predetermined sounds. In addition, light 25 is flashed simultaneously with the flashing of light elements 31 through 33 on collar 30.

In the preferred operation of the present invention, speaker 73 is energized by the sound circuitry within control circuit 70 (seen in FIG. 3) each time switch 71 is activated to initially produce growling sounds followed by barking sounds and thereafter a police siren. In addition, light 25 and light elements 31 through 33 are flashed each time the siren sound is produced by control circuit 70.

In addition to the response of control circuit 70 described above each time switch 71 is activated by depressing light 25, plush toy 10 also provides system response to motion which occurs in front of plush toy 10. Specifically, motion sensors 50 and 51 comprise light responsive sensors which produce electrical signals each time the pattern of light in front of plush toy 10 is significantly altered. Thus, actions such as children moving in and out of the area in front of plush toy 10 or the like are detected by motion sensors 50 and 51 to provide trigger signals to control circuit 70 causing the above-mentioned pattern of sounds and lights to be instituted. Thus, each time a sufficiently large object moves to or from the frontal area of plush toy 10, the above-described pattern of a series of growling sounds followed by barking sounds and thereafter the simultaneous occurrence of flashing of lights 25 and 31 through 33 together with a police siren sound occurs. Thus, the present invention plush toy appears to be "on guard" in its intended play pattern and appears to respond threateningly or alarmingly each time a new object moves into its field of view.

FIG. 3 sets forth a schematic diagram of control circuit 70 as well as several of the associated responsive elements operative therewith. Control circuit 70 includes an operational amplifier 90 having an input 91 coupled to a voltage divider formed by a pair of resistors 96 and 97 and a capacitor 98. Amplifier 90 further includes an input 92 coupled to a pair of light sensors 50 and 51. In their preferred form, light sensors 50 and 51 comprise CDS cells one of which is coupled to ground from input 92 while the other is coupled between input 92 and output 93 of amplifier 90. A pair of filter capacitors 94 and 95 are coupled in parallel with sensors 50 and 51. An amplifier 100 includes an input 101 coupled to ground by a capacitor 105 and to output 93 by a resistor 104. Amplifier 100 further includes an input 102 coupled to output 93 by a resistor 106 and an output 103. A resistor 107 is coupled between output 103 and input 102. In addition, a switch 71 is coupled between input 102 and ground.

An amplifier 110 includes an input 111 coupled to ground by a parallel combination of a resistor 114 and a capacitor 115 and further coupled to output 103 by a resistor 117. Amplifier 110 further includes an input 112 coupled to output 103 by a resistor 116 and an output 113. An integrated circuit 120 having a standard device number W52130 and including conventional sound producing circuitry includes a trigger input terminal 125 coupled to output 113, a supply terminal 126 coupled to a source of operating supply voltage (not shown), a jumper 122 coupled between its STA and TG2 terminals and a resistor 121 coupled between the first and second oscillator terminals of integrated circuit 120. Circuit 120 further includes a ground terminal 127 and an audio-output terminal 123. An NPN transistor 130 includes an emitter 131 coupled to ground, a base 132 coupled to audio-output terminal 123 and to ground by a parallel combination of a resistor 134 and a capacitor 135, and a collector 133 coupled to a source of operating supply by a speaker 73. A plurality of wave shaping components including diode 140, resistors 142 and 145, and capacitors 141, 144 and 148 cooperate to couple the output signal of transistor 130 to amplifier 140. Amplifier 140 includes an input 141 coupled to ground by the parallel combination of a resistor 144 and a capacitor 149 and coupled to capacitor 148 by a resistor 147. Amplifier 140 further includes an input terminal 142 coupled to capacitor 148 and to diode 146, and an output terminal 143. An NPN transistor 150 includes an emitter 151 coupled to ground, a base 152 coupled to output 143 by a resistor 154, and a collector 153. Lamp 25 together with lamps 31 through 33 are coupled to sources of operating supply voltage and to collector 153 of transistor 150. An NPN transistor 160 includes an emitter 161 coupled to ground, a base 162 coupled to ground by a resistor 159, and a collector 163 coupled to terminal 125 of integrated circuit 120. A series combination of a diode 155 and a resistor 157 is coupled between output 143 and base 162. The junction of resistor 157 and diode 155 is coupled to ground by a capacitor 156. A resistor 158 is coupled between base 162 and terminal 124 of integrated circuit 120.

In operation, with control circuit 70 initially inoperative, transistor 130 is nonconducting and speaker 73 remains unenergized. Also, transistor 150 remains nonconductive and therefore lamps 25 and 31 through 33 are also not energized. In the event the light pattern presented to sensors 50 and 51 is significantly changed, the resistance provided by either or both of sensors 50 and 51 is correspondingly changed. The change of resistance of sensors 51 and 50 causes a change in the voltage at input 92 of amplifier 90. This voltage change is amplified at output terminal 93 and coupled to input 102 of amplifier 100. Amplifier 100 responds producing an output signal at output 103 which is coupled to amplifier 110 causing an output signal at output terminal 113 thereof. The output signal from amplifier 110 is coupled to trigger input terminal 125 of integrated circuit 120 causing a series of audio-output signals at output terminal 123 thereof to be produced in accordance with the predetermined sound pattern of integrated circuit 120. The audio-frequency signals at output 123 are amplified by transistor 130 and energize speaker 73 producing the above-described series of sound responses which, in their preferred form, constitute a series of growls followed by a series of barking sounds followed thereafter by a siren sound and the flashing of lights 25 and lights 31 through 33. Diodes 140 and 143 together with the resistive capacitive elements coupled thereto operate to exclude the barking and growling type sound energies from amplifier 140. However, the siren sounds produce sufficient amplified current within transistor 130 to, in turn, produce a sufficient amplitude voltage at collector 133 to overcome this exclusion during the siren sounds and trigger the response of amplifier 140. Amplifier 140 produces an output signal at output 143 which turns on transistor 150 which in turn energizes lamps 25 and 31 through 33. It should be mentioned that in the preferred operation, lamps 25 and 31 through 33 operate in a flashing mode as the siren sounds produced. Accordingly, the components within the coupling networks for diodes 140 and 143 are selected so as to produce an oscillatory input signal for amplifier 140 causing it to conduct intermittently and turn transistor 150 on and off rapidly thereby flashing lamps 25 and 31 through 33.

In its preferred form, the operation of control circuit 70 is intended to play through the predetermined sequence of sounds in an uninterrupted manner despite the occurrence of additional movement in front of the present invention plush toy. Accordingly, a sample of the output signal from amplifier 140 at output terminal 143 is coupled to transistor 160 and operates to turn transistor 160 on when amplifier 140 is active. The conduction of transistor 160 temporarily grounds trigger input terminal 125 of integrated circuit 120 precluding the application of additional triggering to integrated circuit 120. However, once the sound sequence is complete and amplifier 140 ceases operation, transistor 160 is again nonconductive and integrated circuit 120 can accept additional trigger signals and institute additional sound sequences.

In addition to the operation of control circuit 70 in response to motion sensed by sensors 50 and 51, the manipulation of switch 71 is also capable of initiating the above-described circuit operation. In other words, closure of switch 71 temporarily changes the input signal condition at input 102 of amplifier 100 simulating the action of amplifier 90 in response to motion sensing. As a result, with switch 71 temporarily closed a brief signal is applied to amplifier 100 causing it to become active and initiating the above-described operation of control circuit 70.

FIG. 3 also shows the schematic diagram for battery-powered light source 41. It will apparent, however, that light source 41 may be constructed in accordance with virtually any conventionally available technology to provide a squeeze-operated light supported within foot 12 of plush toy 10 (seen in FIG. 2). Specifically, battery-powered light source includes a battery 118, a switch 119, a switch 48 and a bulb 52. For purposes of convenience, battery 118 also provides the operating power for control circuit 70. To preclude undue battery use, a power switch 119 is interposed between the power connections for control circuit 70 and battery, 118. Switch 41 is, as mentioned above, squeeze operated within foot 12 of plush toy 10 to complete the battery circuit for lamp 52 and energize the light within foot 12 of plush toy 10 (seen in FIG. 2). Thus, it will be apparent that the operation of power switch 119 serves to enable and disable both control circuit 70 and the foot supported light for the present invention plush toy.

What has been shown is a novel and unusual plush toy which supports a foot mounted light together with a plurality of flashable lights in combination with a pair of light responsive motion sensors. In the anticipated play pattern, the flashing lights accompanied by appropriate sounds may be instituted simply by a motion change in front of the present invention plush toy. This adds an interesting variant to the present invention plush toy and enhances the "on guard" theme of the present invention plush toy. It will be apparent to those skilled in the art, however, that while a guard dog or police dog type plush toy is utilized in the present invention, additional alternatively themed plush toys may be used without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A toy comprising:

a body defining a four legged animal having a movable front leg appendage defining a bottom surface and an aperture therein;

a switch operated light source supported within said movable front leg appendage so as to cause light to shine outwardly through said aperture;

circuit means for producing a predetermined series of audible sounds; and motion sensing means responsive to object movement in proximity to said body operating to activate said circuit means.

2. A toy as set forth in claim 1 wherein said circuit means further includes a plurality of light-producing elements and means for energizing said light-producing elements during portions of said series of sounds.

3. A toy as set forth in claim 2 wherein said circuit means includes a manual trigger switch for activating said circuit means notwithstanding the absence of object movement.

4. A toy as set forth in claim 3 wherein said plurality of light-producing elements include a plurality of electric bulbs supported upon said body.

5. A toy as set forth in claim 4 wherein said light source includes an on/off switch operative in response to squeezing said one of said front legs.

6. A toy as set forth in claim 5 wherein said body includes a head supporting one of said light producing elements and wherein said manual trigger switch is operated by pushing upon said one light producing element.

7. A toy comprising:

a body formed to generally resemble a dog having four legs, a neck and a head, one of said legs defining an aperture therein;

a plurality of lights supported upon said body including a light supported upon said head having a switch operable when said light is pressed to provide said trigger signal to said control circuit;

a light source supported within said one of said legs so as to shine light outwardly therefrom through said aperture;

a sound producing circuit having an acousto-electric transducer;

a control circuit responsive to a trigger signal for flashing said plurality of lights and energizing said sound producing circuit; and motion sensing means for sensing object motion proximate said body and producing said trigger signal.

8. A toy as set forth in claim 7 wherein said motion sensing means include a light-responsive sensor operative in response to light level changes.

9. A toy comprising:

a body defining a four legged animal having a movable front leg appendage defining a bottom surface and an aperture therein;

a switch operated light source supported within said movable front leg appendage so as to cause light to shine outwardly through said aperture;

circuit means for producing a predetermined series of audible sounds including a plurality of light-producing elements including a plurality of electric bulbs supported upon said body and means for energizing said light-producing elements during portions of said series of sounds and a manual trigger switch for activating said circuit means; and motion sensing means responsive to object movement in proximity to said body operating to activate said circuit means.

10. A toy as set forth in claim 9 wherein said light source includes an on/off switch operative in response to squeezing said one of said front legs.

11. A toy as set forth in claim 10 wherein said body includes a head supporting one of said light producing elements and wherein said manual trigger switch is operated by pushing upon said one light producing element.

* * * * *